US008096839B2

(12) United States Patent
Abughazaleh et al.

(10) Patent No.: US 8,096,839 B2
(45) Date of Patent: Jan. 17, 2012

(54) TELECOMMUNICATIONS CONNECTOR PANEL WITH INTERPORT CROSSTALK ISOLATION

(75) Inventors: Shadi A. Abughazaleh, Oakdale, CT (US); Joseph E. Dupuis, Ledyard, CT (US); Christopher W. Gribble, Westerly, RI (US); Naved S. Khan, Portland, CT (US); Douglas P. O'Connor, Richmond, RI (US)

(73) Assignee: Hubbell Incorporated, Shelton, CT (US)

( * ) Notice: Subject to any disclaimer, the term of this patent is extended or adjusted under 35 U.S.C. 154(b) by 15 days.

(21) Appl. No.: 12/634,909

(22) Filed: Dec. 10, 2009

(65) Prior Publication Data

US 2010/0151710 A1 Jun. 17, 2010

Related U.S. Application Data

(60) Provisional application No. 61/193,654, filed on Dec. 12, 2008.

(51) Int. Cl.
*H01R 24/00* (2006.01)

(52) U.S. Cl. ..... 439/676

(58) Field of Classification Search ..... 439/676, 439/941, 607.04; 340/639, 607.04; 379/413.04
See application file for complete search history.

(56) References Cited

U.S. PATENT DOCUMENTS

| | | | | |
|---|---|---|---|---|
| 4,941,848 | A * | 7/1990 | Philippson et al. | 439/607.04 |
| 5,432,484 | A | 7/1995 | Klas et al. | |
| 5,673,009 | A | 9/1997 | Klas et al. | |
| 5,938,479 | A * | 8/1999 | Paulson et al. | 439/676 |
| 6,062,907 | A * | 5/2000 | Tan et al. | 439/607.41 |
| 6,796,847 | B2 * | 9/2004 | AbuGhazaleh et al. | 439/676 |
| 7,278,879 | B2 * | 10/2007 | Kim et al. | 439/540.1 |
| 2007/0274515 | A1 | 11/2007 | McNutt et al. | |
| 2008/0038941 | A1 * | 2/2008 | Bartholomew | 439/76.1 |
| 2009/0098777 | A1 | 4/2009 | AbuGhazaleh et al. | |
| 2009/0300959 | A1 | 12/2009 | McNutt et al. | |

* cited by examiner

*Primary Examiner* — Alexander Gilman
(74) *Attorney, Agent, or Firm* — Alan I. Cantor; Mark S. Bicks; Alfred N. Goodman

(57) ABSTRACT

A multi-port telecommunications connector panel has an electrically conductive housing that defines a plurality of ports, each with a plug receiving cavity aligned with a respective set of jack contacts. The housing surrounds the sets of jack contacts individually and collectively to separate and isolate adjacent ports. Electrically conductive isolation barriers, which are electrically connected to and may be integral with the housing, separate adjacent sets of insulation displacement contacts, which are arranged in an offset pattern.

27 Claims, 14 Drawing Sheets

TELECOMMUNICATIONS CONNECTOR PANEL WITH INTERPORT CROSSTALK ISOLATION

CROSS REFERENCE TO RELATED APPLICATIONS

This application claims the benefit of Provisional Application Ser. No. 61/193,654, filed Dec. 12, 2008. This application also is related to application Ser. No. 12/285,428 of Shadi A. AbuGhazaleh and Douglas P. O'Connor, filed Oct. 3, 2008, and entitled Crosstalk Prevention Cover (published under No. US 2009/0098777), and application Ser. No. 12/314,613 of Shadi AbuGhazaleh, Joseph E. Dupuis, Naved S. Khan, Christopher W. Gribble and Douglas P. O'Connor, filed Dec. 12, 2008, and entitled Electrical Connector with Separate Contact Mounting and Compensation Boards. The subject matter of each of the aforementioned three applications is herein incorporated by reference in its entirety.

FIELD OF THE INVENTION

The present invention relates to multi-port telecommunication connector panels, specifically to measures for minimizing or preventing inter-port and intra-port crosstalk, and to measures for otherwise enhancing the performance of such connector panels.

BACKGROUND OF THE INVENTION

Due to advancements in telecommunications and data transmissions speeds over balanced, twisted-pair cables, the connectors (such as jacks, plugs, patch panels, cross connects, etc.) are now a critical impediment to high performance data transmission at higher frequencies. Performance characteristics, particularly crosstalk and return loss, degrade beyond acceptable levels at higher frequencies. This degradation is particularly true for system operation at category 6 and category 6A levels.

When an electric signal is carried on a signal line that is in close proximity to another signal line or lines carrying a signal or signals, such as in the case of adjacent pins of contacts in the connector, energy from one signal line can be coupled into adjacent signal lines by the electric field generated by the potential between the two signal lines and the magnetic field generated as a result of the changing electrical fields. This coupling, whether capacitive or inductive, is called crosstalk.

Crosstalk is a noise signal that degenerates the signal-to-noise margin or ratio (S/N) of the system. In telecommunication systems, reduced S/N margins result in greater error rates in the information conveyed on the signal line. The S/N margin must satisfy set performance criteria for the system category involved.

Crosstalk problems could be overcome by increasing the spacing between the signal lines, or by shielding the individual signal lines. In many cases, the wiring is preexisting and standards define the geometries and pin definitions for connectors, making the necessary changes to such systems cost-prohibitive. In the specific case of communication systems using balanced, twisted-pair wiring, standards defining connector geometries and pin out definitions are in effect, but were created prior to the need for high speed data communications.

These standards have created a large base of wiring and connectors and a need for connectors capable of meeting the requirements of high speed communications, while maintaining compatibility with the original connectors. The standard connector geometries and pin outs are such that a great deal of crosstalk occurs at higher signal frequencies.

Numerous connector constructions have been developed to address crosstalk problems. Minimizing near end cross talk between the signal lines of an individual connector typically involves counteracting a noise signal in a line by inducing in that line a signal equal to and opposite to the noise signal such that the induced noise signal is effectively cancelled by the induced correction signal. Examples of such connectors are disclosed in U.S. Pat. Nos. 5,432,484, 5,673,009 and 6,796,847, the subject matter of each of which is herein incorporated by reference. Alien crosstalk between the conductors of adjacent connectors has been addressed by applying separate dedicated shielding components around individual connectors. See, e.g., patent application publication No. US 2009/0098777.

SUMMARY OF THE INVENTION

As used in this application, the terms "top", "bottom", "side", "front", "rear" and the like are intended to facilitate the description of the electrical connector panel and parts thereof. Such terms are merely illustrative of the connector panel and its parts, and are not intended to limit the connector panel and its parts to any specific orientation.

The invention utilizes electrically conductive housing portions and barriers that separate and serve to isolate adjacent ports and adjacent sets of insulation displacement contacts associated with different ports. As used herein to describe such housing portions and barriers, the term "electrically conductive" means containing conductive materials or elements that impart at least partial local conductivity substantially throughout such housing portions and barriers.

From one perspective, the invention is embodied in a telecommunications connector assembly comprising an electrically conductive housing defining at least one port having a plug receiving cavity. A set of jack contacts in the port is adapted to mate with respective contacts of an inserted connector plug, and is electrically connected to a set of insulation displacement contacts. The jack contacts are substantially surrounded by and electrically insulated from the housing. An electrically conductive isolation barrier is adjacent the set of insulation displacement contacts and is electrically connected to the housing. Thus, the isolation barrier would separate the sets of insulation displacement contacts of adjacent ports. The isolation barrier may be integrally formed with the housing.

From another perspective, the invention is embodied in a multi-port telecommunications panel comprising a mounting circuit board, a plurality of sets of insulation displacement contacts on the circuit board, and a plurality of sets of jack contacts on the circuit board. Each set of jack contacts is electrically connected to a respective set of insulation displacement contacts and is adapted to mate with respective contacts of an inserted connector plug. An electrically conductive housing, which is electrically insulated from the jack contacts, substantially surrounds and separates the sets of jack contacts to define a plurality of ports, each port having a plug receiving cavity aligned with a respective set of jack contacts. An electrically conductive isolation barrier is disposed between each pair of adjacent sets of insulation displacement contacts. Each isolation barrier is electrically connected to the front housing. The isolation barriers may be integrally formed with the housing. The jack contacts and the insulation displacement contacts may extend from opposite sides of the circuit board, or from the same side of the circuit board.

From yet another perspective, the invention is embodied in a multi-port telecommunications panel comprising a mounting circuit board having opposed front and rear faces; a plurality of sets of insulation displacement contacts extending from the rear face of the mounting circuit board; a plurality of sets of jack contacts extending from the front face of the mounting circuit board; and an electrically conductive front housing at the front face of the mounting circuit board substantially surrounding the sets of jack contacts individually and collectively to define a plurality of ports, each with a plug receiving cavity aligned with a respective set of jack contacts. Each set of jack contacts is electrically connected to a respective set of insulation displacement contacts and is adapted to mate with respective contacts of an inserted connector plug. The front housing is electrically insulated from the jack contacts and has an isolation barrier associated with each pair of adjacent sets of insulation displacement contacts. Each isolation barrier extends rearward beyond the mounting circuit board between the adjacent sets of insulation displacement contacts.

Each set of jack contacts preferably is supported in a module having an electrically insulating frame. Preferably, adjacent insulation displacement contacts of adjacent sets of insulation displacement contacts are offset. And adjacent insulation displacement contacts of each set preferably are offset.

Each isolation barrier preferably comprises a pair of spaced substantially parallel plates occupying the region between the adjacent sets of insulation displacement contacts. The plates preferably are paddle-shaped and are substantially congruent. Each isolation barrier preferably passes through a respective slot in the mounting circuit board. Each slot preferably is at an edge of the mounting circuit board. The front housing and the isolation barriers preferably are made of a conductive thermoplastic resin.

An electrically insulating rear housing covers the rear face of the mounting circuit board and flanks the insulation displacement contacts. The rear housing has an opening aligned with each slot in the mounting circuit board, through which opening an isolation barrier extends. The rear housing is secured to the front housing by fasteners, such as screws, thus sandwiching the mounting circuit board therebetween.

If the front housing does not completely cover the front of the mounting circuit board, an electrically insulating shroud can be provided that surrounds the front housing and covers the remainder of the front of the mounting circuit board. The shroud is secured to the rear housing, preferably by snap tabs that project from the shroud and engage mating shoulders on the rear housing.

The mounting circuit board has electrically conductive traces that connect the jack contacts to their respective insulation displacement contacts. The mounting circuit board preferably includes a ground plane for each port adjacent its electrically conductive traces for optimizing common mode impedance.

BRIEF DESCRIPTION OF THE DRAWING FIGURES

A preferred embodiment of the disclosed invention, which includes the best mode for carrying out the invention, is described in detail below, purely by way of example, with reference to the accompanying drawing, in which.

DETAILED DESCRIPTION OF THE INVENTION

Figure 1:
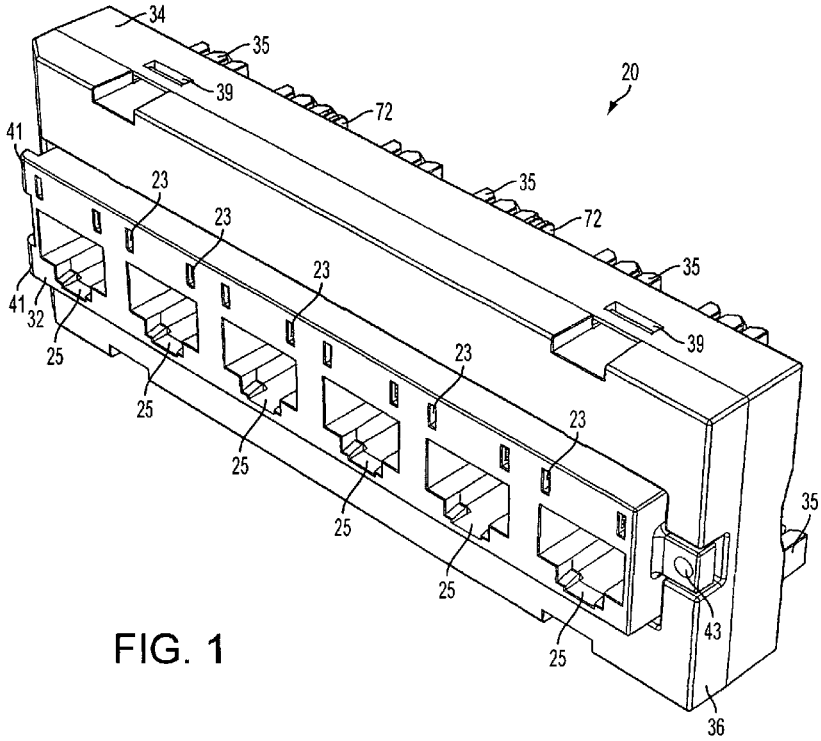
FIG. 1 is a front and top perspective view of the electrical connector panel with multiple shielded ports and shielded, offset insulation displacement contacts according to an exemplary embodiment of the present invention.
Figure 2:
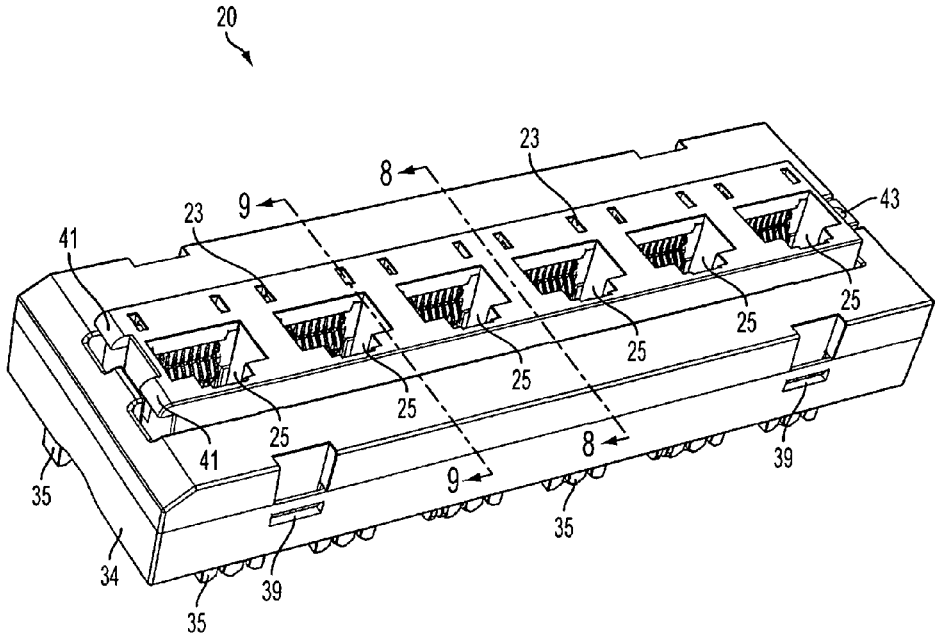
FIG. 2 is a front and bottom perspective view of the electrical connector panel of FIG. 1.
Figure 3:
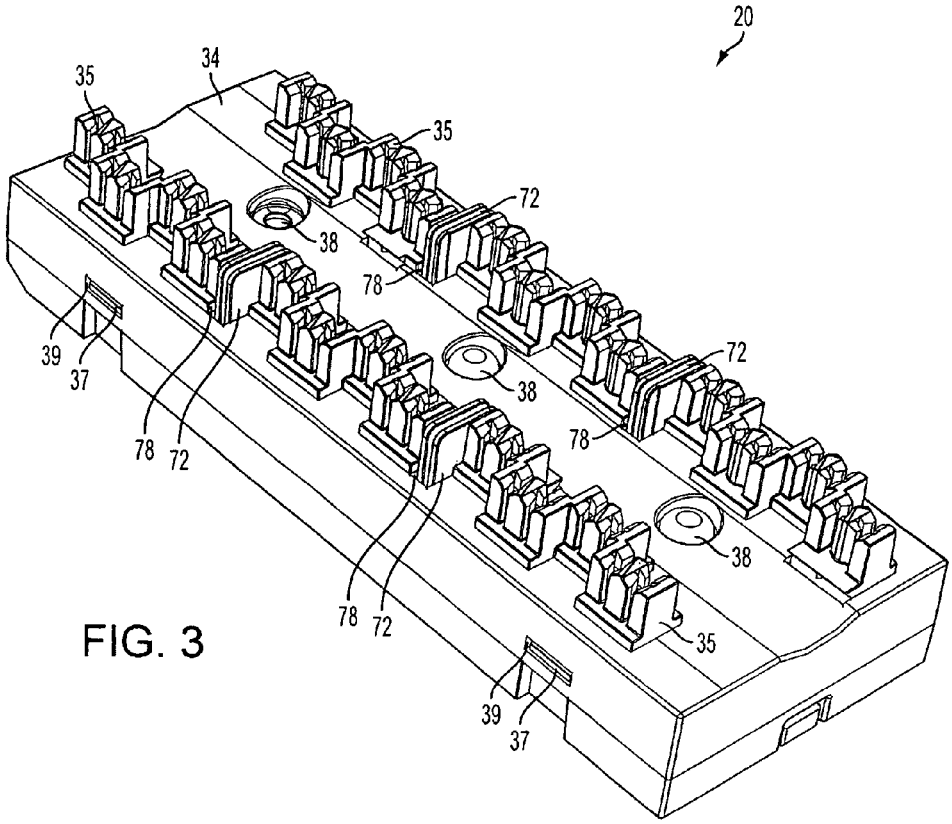
FIG. 3 is a rear and top perspective view of the electrical connector panel of FIG. 1.

Referring to FIGS. 1-8, the electrical connector panel 20 of the invention has at its core a mounting circuit board 22 that supports six contact modules 24, which extend from the front face 26 of the circuit board, and six sets of insulation displacement contacts (IDCs) 28, which extend from the rear face 30 of the circuit board. Each set of eight IDCs is electrically connected to the eight jack contacts 29 of a respective contact module 24 via electrically conductive traces on the circuit board 22 (see FIG. 13). Contact module 24 has an electrically insulating frame 31 supporting jack contacts 29.

Figure 16:
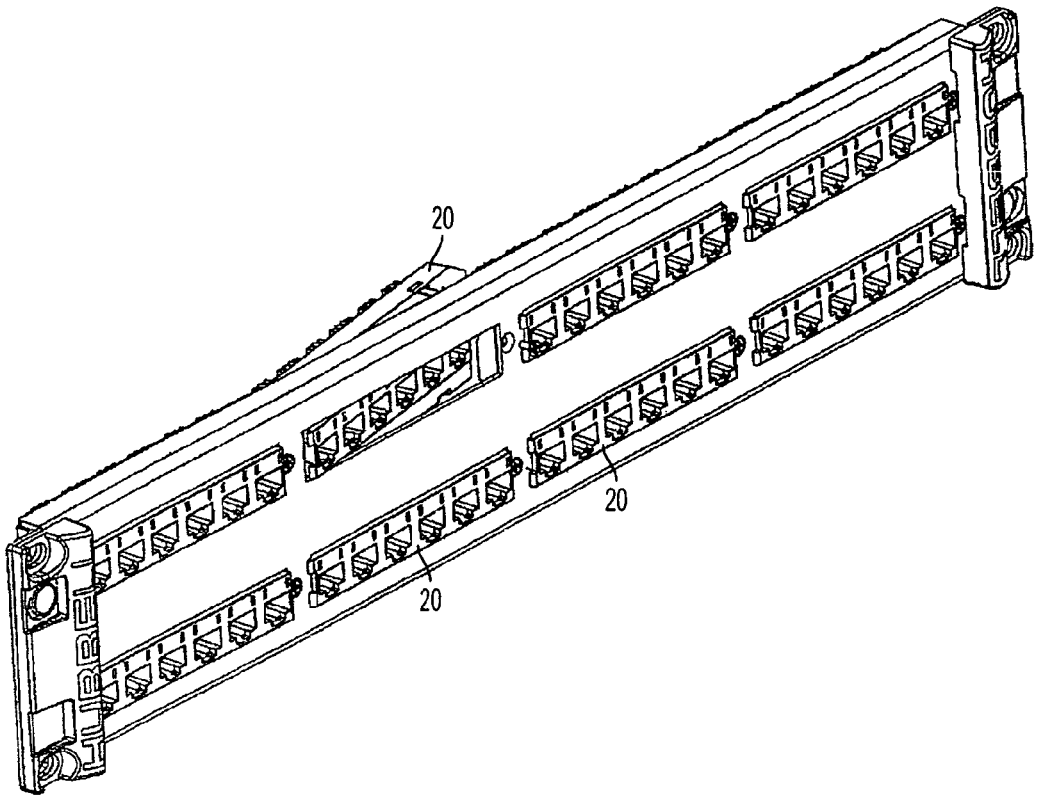
FIG. 16 is a front perspective view of eight electrical connector panels according to FIG. 1, installed in a common metal support panel.

A front (nose) housing 32, preferably molded of a conductive thermoplastic material, covers the contact modules 24. The material for the front housing 32 preferably is a stainless steel fiber filled thermoplastic resin. A preferred example of such material is a thermoplastic marketed under the name FARADEX by SABIC Innovative Plastics of Pittsfield, Mass. Alternatively, front housing 32 could be completely metallic. Front housing 32 has six port openings 25 into respective plug receiving cavities 27, each aligned with the jack contacts of a respective contact module 24. Two mounting slots 23 above each port opening accommodate a port identification label. Front housing 32 also has hooks 41 at one end, and a tab with a screw hole 43 at the opposite end, that facilitate mounting the connector panel 20 in a common metal support panel (see FIG. 16).

A rear housing 34, molded of an insulating thermoplastic material, covers the rear face 30 of the circuit board and has portions 35 that extend rearward and flank the IDCs 28. Fasteners, preferably in the form of screws 38, pass through holes 40 in rear housing 34 and holes 42 in circuit board 22, to threadably engage blind holes 44 in the back of front housing 32. An insulating molded plastic shroud 36 surrounds front housing 32 and covers the remainder of the front face 26 of the circuit board. Shroud 36 has resilient snap tabs 37 that mate with recesses 39 in rear housing 34. Shroud 36 could be eliminated if the front housing 32 were broad enough to cover the entire circuit board 22.

Figure 5:
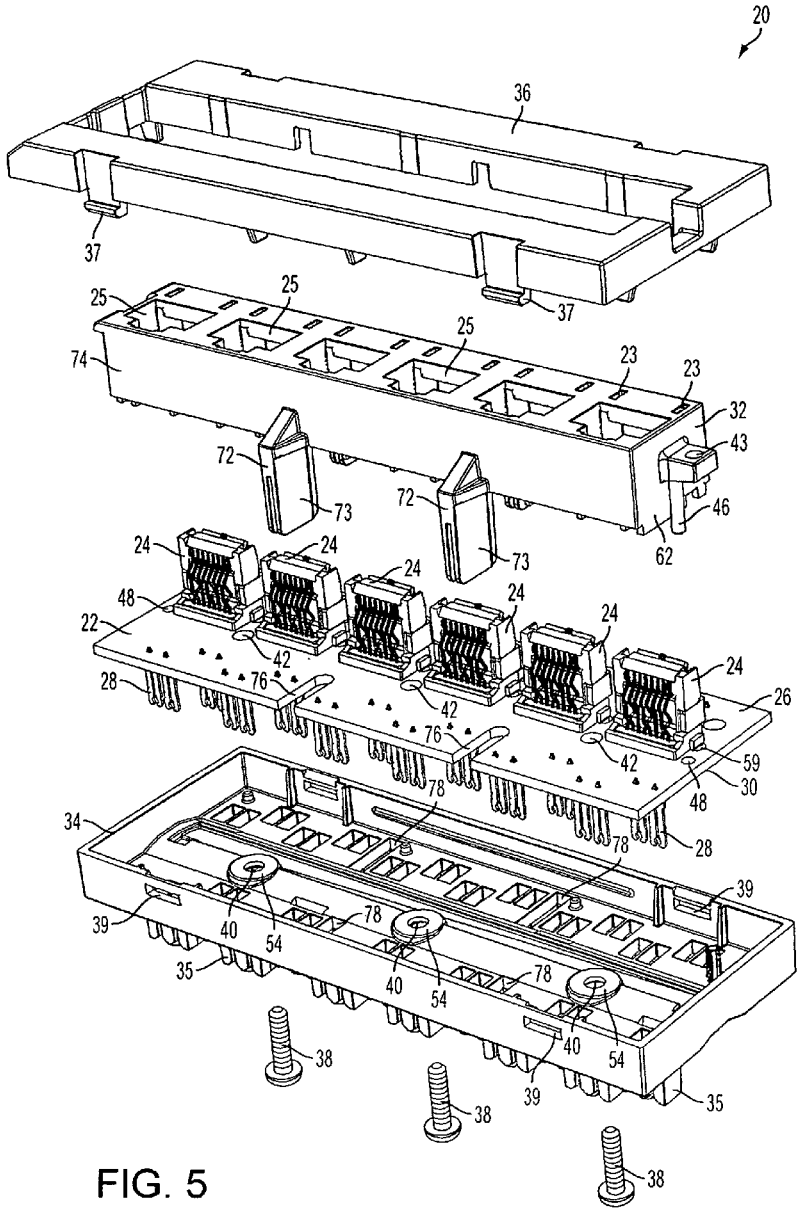
FIG. 5 is an exploded perspective view of the electrical connector panel of FIG. 1.
Figure 6:
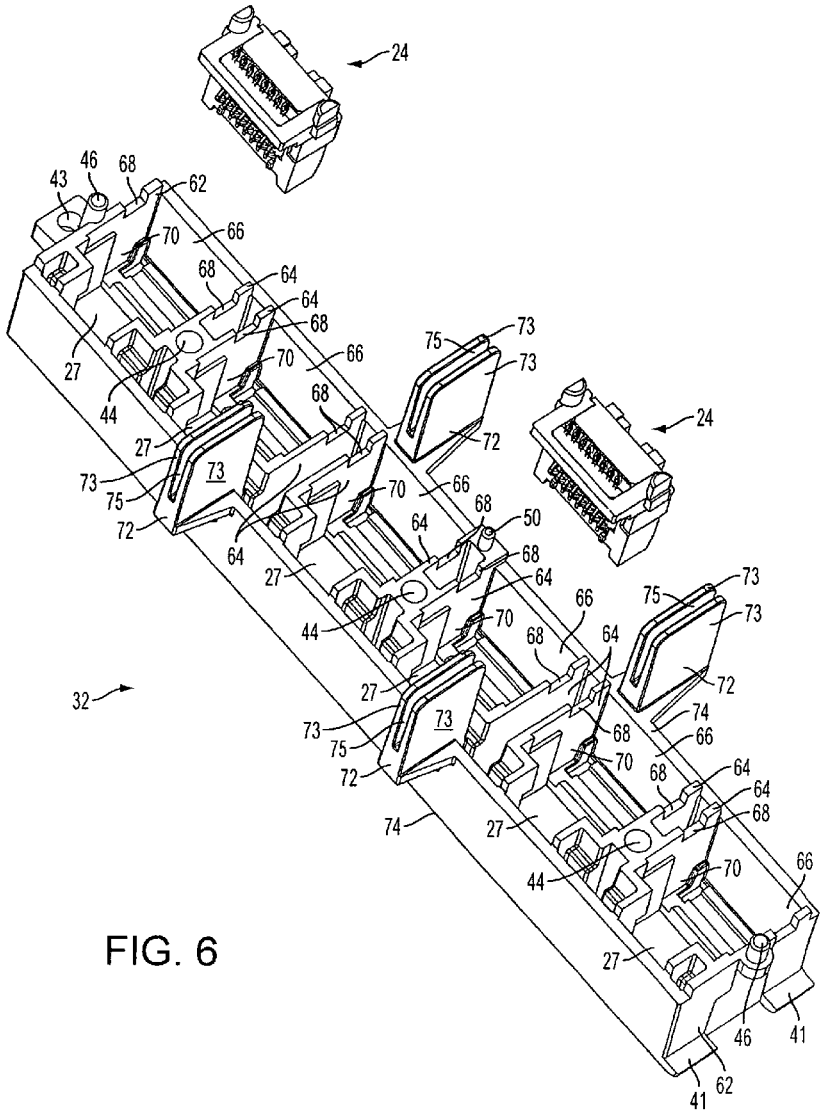
FIG. 6 is an exploded rear perspective view of the front housing and two contact modules of the electrical connector panel of FIG. 1.
Figure 7:
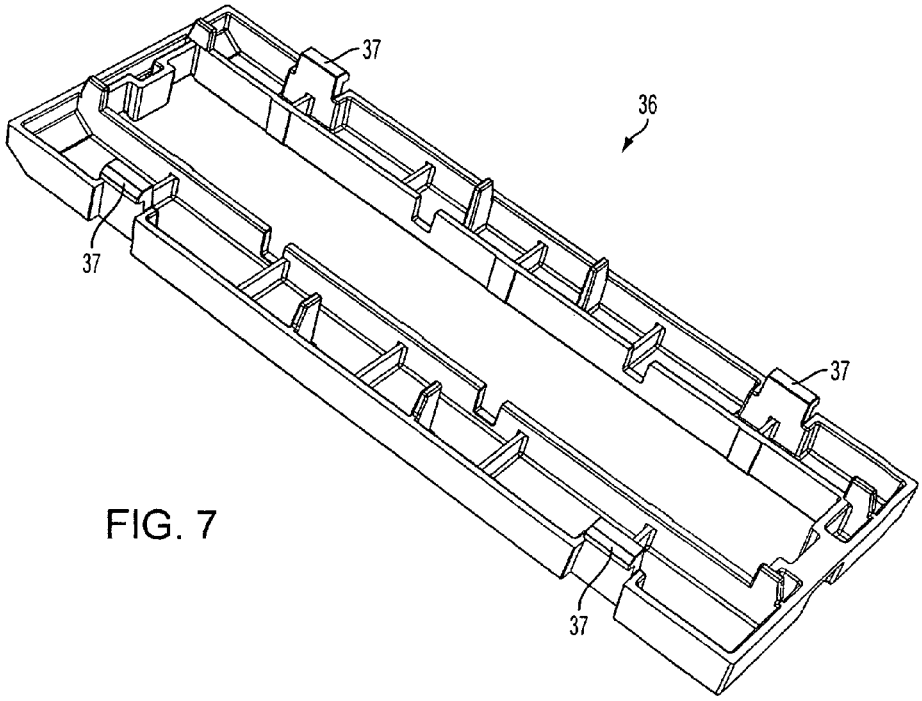
FIG. 7 is a rear and top perspective view of the shroud of the electrical connector panel of FIG. 1.
Figure 8:
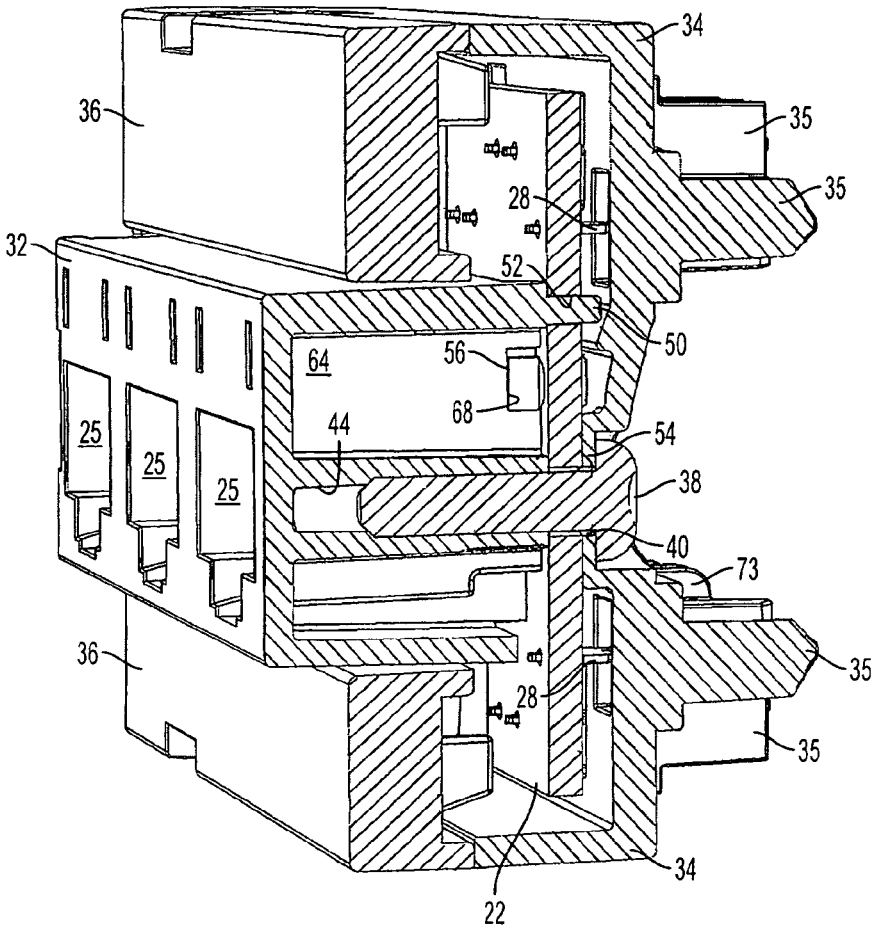
FIG. 8 is an end perspective view in medial transverse cross-section of the electrical connector panel, taken along line 8-8 in FIG. 2.
Figure 9:
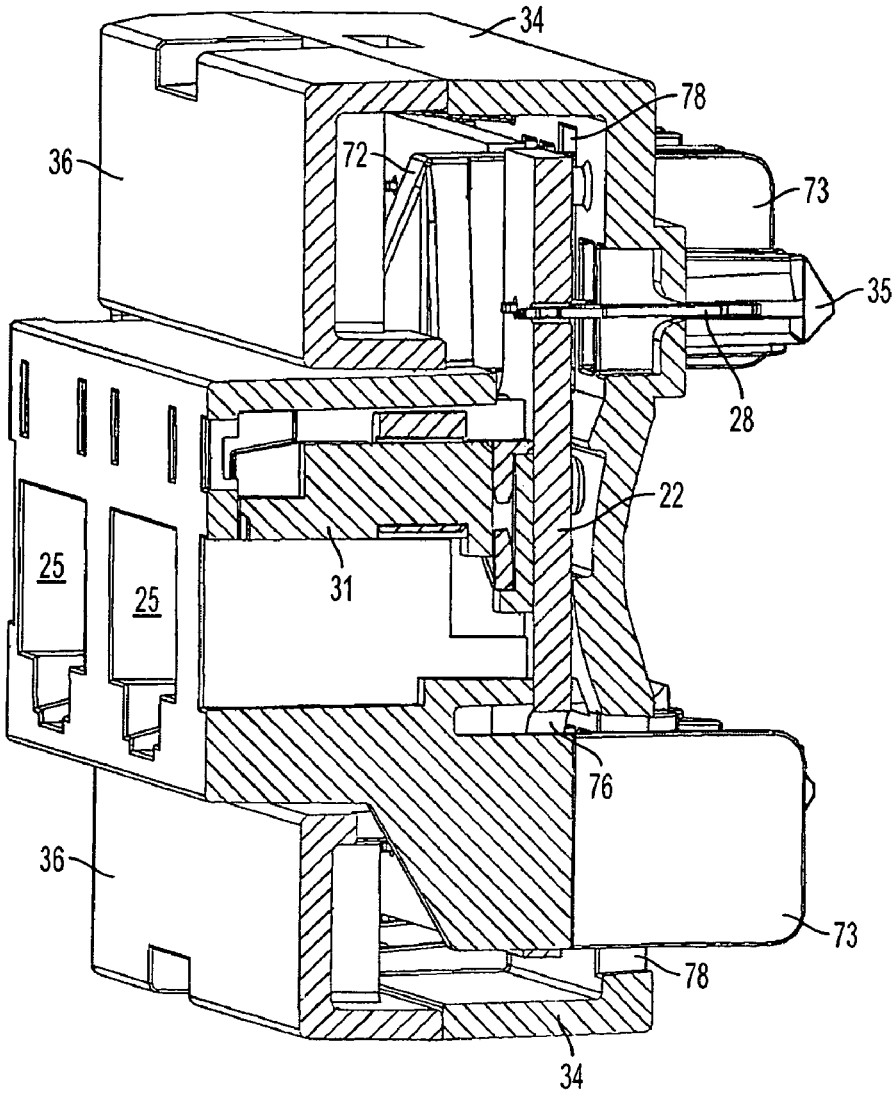
FIG. 9 is an end perspective view in transverse cross-section of the electrical connector panel, taken along line 9-9 in FIG. 2.

The screws 38, which secure the front and rear housings together, force the sandwiched mounting circuit board 22 into position against front housing 32 to take up tolerances. Referring to FIGS. 5, 6 and 8, proper alignment of front housing 32 and circuit board 22 is ensured by end locating pins 46 on front housing 32 that engage mating end locating holes 48 in circuit board 22, and by a central locating pin 50 on front housing 32 that engages a mating central locating hole 52 on circuit board 22. Each screw hole 40 in rear housing 34 is surrounded by a boss 54 that abuts the rear face 30 of the circuit board 22 to ensure a tight assembly (see FIG. 8).

Figure 10:
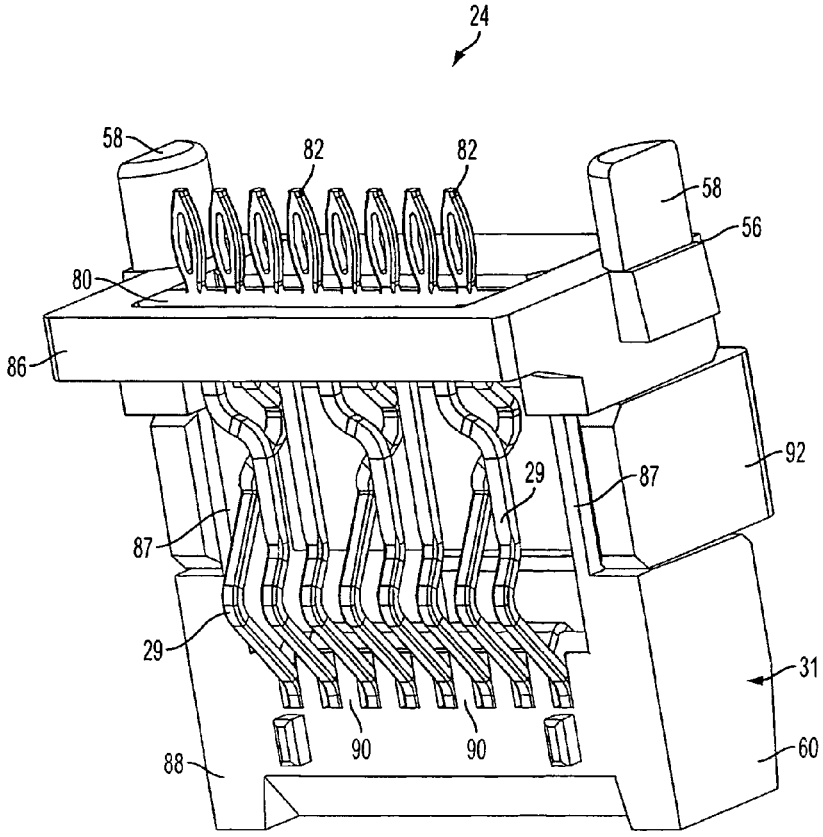
FIG. 10 is a perspective view of a contact module of the electrical connector panel of FIG. 1.
Figure 11:
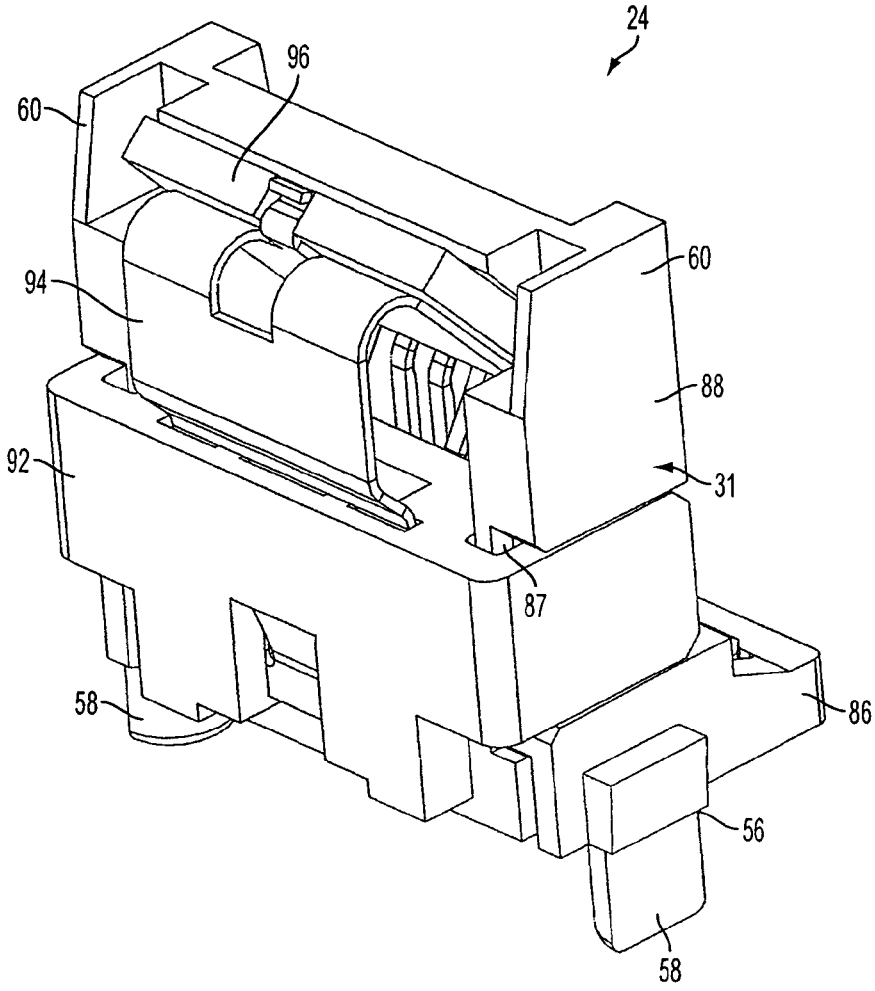
FIG. 11 is a different perspective view of a contact module of the electrical connector panel of FIG. 1.

Front housing 32 has interlocking features that ensure proper alignment with contact modules 24, thus ensuring proper mechanical functioning of the contact system. Referring to FIGS. 10 and 11, each side of the insulating frame 31 of contact module 24 has a lateral shoulder 56 adjacent a circuit board locating pin 58 (which engages a mounting hole 59 in circuit board 22), and a tapered side wall 60. Referring to FIG. 6, end walls 62 and intermediate walls 64 of front housing 32 are spaced to closely receive contact modules 24 at six locations 66. As viewed in FIG. 6, the contact modules 24 (only two are shown for the sake of clarity) are positioned with their locating pins 58 facing up and their electrically conductive jack contacts 29 facing left, toward plug receiving cavities 27. Each end wall 62 and each intermediate wall 64 has a notch 68 sized to embrace a lateral shoulder 56 of a contact module 24, and a tapered recess 70 sized to embrace an upper tapered side wall 60 of a contact module 24. Thus, when rear housing 34 is secured by screws 38 to front housing 32 with mounting circuit board 22 sandwiched therebetween, contact modules 24 are snugly positioned in notches 68 and recesses 70.

Figure 4:
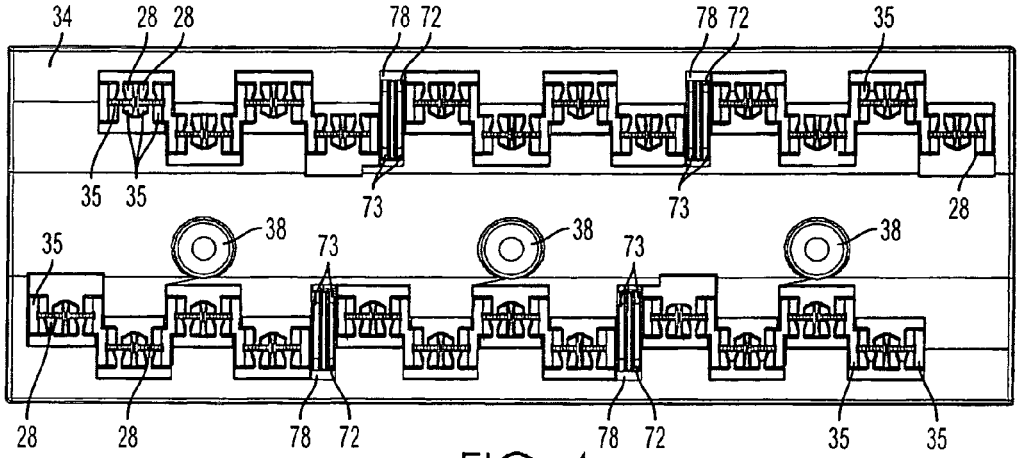
FIG. 4 is a rear elevation of the electrical connector panel of FIG. 1.

Front housing 32 also has four isolation barriers 72 cantilevered from its elongated walls 74. Isolation barriers 72 extend rearward through edge slots 76 in mounting circuit board 22, through aligned openings 78 in rear housing 34, and between adjacent sets of IDCs 28. Each isolation barrier 72 comprises a pair of spaced, congruent paddle-shaped plates 73 separated by an air gap 75. Referring to FIG. 4, the IDCs 28 are arranged in two rows (upper and lower) of three sets each, each set having four pairs of IDCs (for connection to twisted pair cabling). Two isolation barriers 72 extend between the adjacent sets of IDCs of each row, thus separating the IDC sets associated with their three respective ports and contact modules 24. The IDCs are also arranged in an offset pattern of pairs. Specifically, each pair of IDCs is offset from any adjacent pair, both within and between each set. Accordingly, no two pairs of IDCs directly flank each other, which helps to separate twisted pairs and reduce crosstalk.

The electrically conductive nature of front housing 32 is inherent in all of its parts. Thus, intermediate walls 64 shield the contacts of adjacent contact modules from one another, minimizing alien crosstalk at the ports. Further, the face and the surrounding walls 62, 74 of front housing 32 shield the contacts of all ports from extraneous electromagnetic interference. In addition, the isolation barriers 72 between the sets of IDCs provide improved crosstalk isolation. A solid barrier would function to provide some improvement (reduction) in the level of alien crosstalk (as compared to no barrier) because of the solid barrier's shielding effect, but it would still result in secondary capacitive coupling between adjacent IDCs. Split isolation barriers with an intermediate air gap 75 between plates 73 are preferred because they provide better crosstalk isolation by further reducing the coupling and, therefore, alien crosstalk.

Several structures electrically insulate the jack contacts 29 of each contact module 24 from the conductive front housing 32. Referring to FIGS. 10 and 11, the jack contacts 29 are mounted in an electrically insulating overmold 80, from which the compliant pin terminal ends 82 of jack contacts 29 protrude. Pin terminals 82 extend through holes 84 in the mounting circuit board 22 and electrically connect to conductive traces therein (see FIG. 13). Electrically insulating frame 31 has a proximal portion 86 surrounding and supporting overmold 80, a central portion 87 flanking the jack contacts 29, and a distal portion 88 with comb-like teeth 90 that separate the other ends of jack contacts 29. Further, an electrically insulating spring retainer 92 for a spring 94 embraces the central portion 87 of the frame. Spring 94 resiliently supports a compensation circuit board 96 having separate contacts (not shown) that connect with jack contacts 29 when a connector plug is inserted into the plug receiving cavity 27.

Details of the spring-biased compensation circuit board and contact arrangement are disclosed in the aforementioned application Ser. No. 12/314,613. Crosstalk compensation typically is applied to the connectors at one or more of three locations in the manner described in application Ser. No. 12/314,613, namely: (1) near the distal ends of the jack contacts through the spring-mounted compensation circuit board 96, (2) at the jack contact mounting locations through the mounting circuit board 22, and (3) at the IDC locations through the mounting circuit board 22. Compensation can be applied at other locations as would be understood by those skilled in the art.

FIGS. 12-15 separately depict the four superposed layers of conductive traces that comprise the electrical circuitry in mounting circuit board 22. The superposed conductive traces of different layers are electrically insulated from each other in a manner that would be readily recognized by one skilled in the art. These figures also depict mounting holes 97 for the IDCs 28, mounting holes 59 for the contact modules 24, and holes 84 for the pin terminals 82 of the jack contacts. All of the holes 84 are aligned because the ports 25 and the contact modules 24 are aligned.

Figure 12:
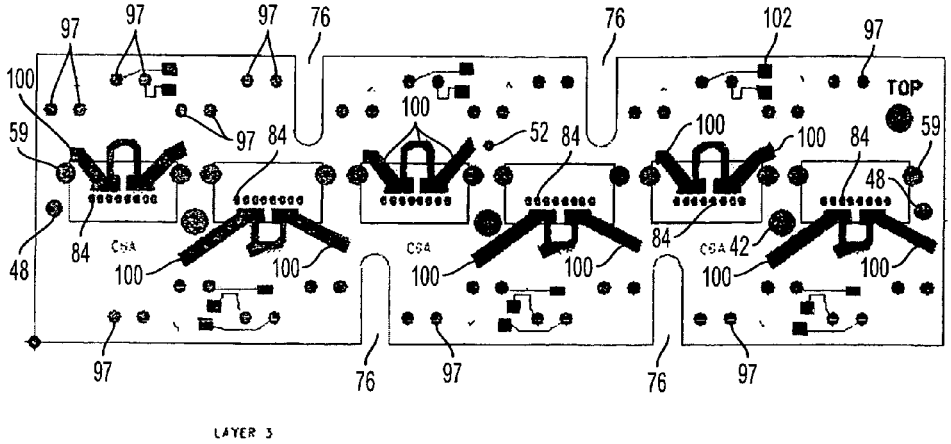
FIGS. 12-15 are top plan views of the conductive trace layers of the mounting circuit board of the electrical connector panel of FIG. 1.
Figure 13:
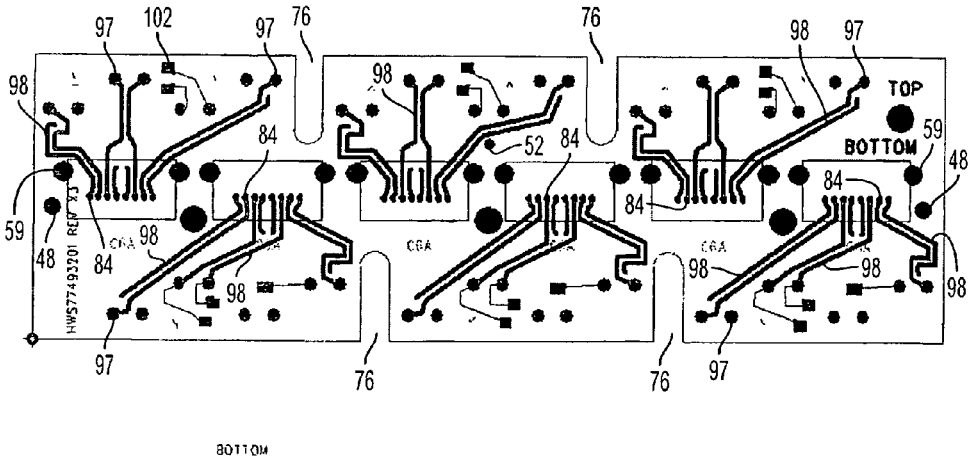
Figure 14:
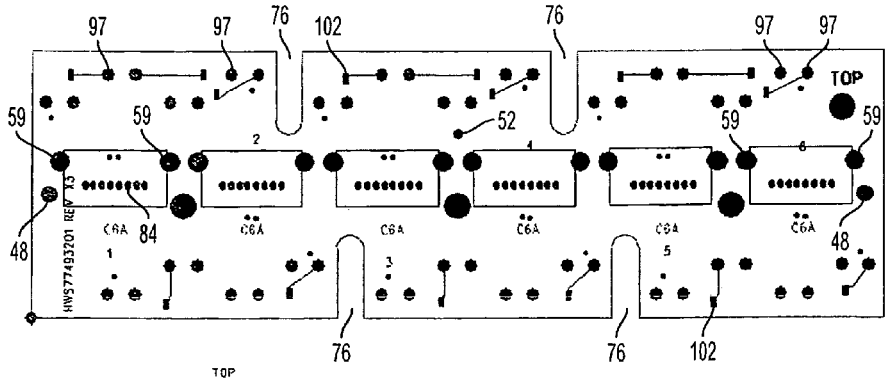
Figure 15:
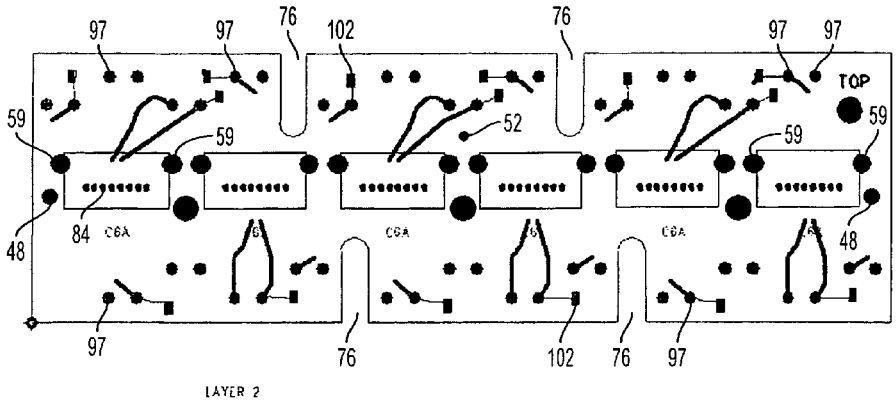

FIG. 13 depicts the fourth (bottom) layer with the main signal traces 98 that connect to jack contacts 29 via pin terminals 82, which extend through holes 84. FIG. 12 depicts the third layer (disposed just above the bottom layer) that has ground planes 100 located directly above major portions of the main signal traces 98 (FIG. 13). This adjacent arrangement optimizes common mode impedance to improve common mode return loss and reduce noise reflections and associated excess alien crosstalk normally observed when connectors are in close proximity to each other along the length of a cabling link. FIG. 15 depicts the second layer, which is disposed above the third layer of FIG. 12. FIG. 14 depicts the first (top) layer, which is disposed just above the second layer of FIG. 15. The spacing between the second and third layers preferably is greater than the spacing between the first and second layers, and greater than the spacing between the third and fourth layers.

Compensation elements and related traces are present in all layers of the circuit board 22. The compensation elements are in the form of plates 102. The sizes and relative positions of the compensation plates provide appropriate capacitive and inductive coupling for cancellation of crosstalk induced in other portions of the electrical connector panel.

The preferred embodiment of the invention illustrated and described herein is merely an example. It will be understood by those skilled in the art that other embodiments incorporating various changes and modifications also are considered to be within the scope of the invention, which is defined in the appended claims. For example, and without limitation, the electrically conductive front housing may be formed separately from the electrically conductive isolation barriers, with provision made for the barriers and the front housing to become electrically connected when the connector panel is assembled. The isolation barriers, whether integral with or separate from the front housing, could extend around, rather than through the mounting circuit board. For a front-access connector panel, in which the insulation displacement contacts and the jack contacts are on the same (front) face of the mounting circuit board, the isolation barriers would be fully disposed in front of the mounting circuit board. The number of ports can be fewer or greater than the six ports of the preferred embodiment; and the number of jack contacts per set can be fewer or greater than the eight jack contacts per set of the preferred embodiment.

What is claimed is:

1. A multi-port telecommunications connector panel comprising:

a continuous mounting circuit board having opposed front and rear faces;

a plurality of sets of insulation displacement contacts extending from the rear face of the mounting circuit board;

a plurality of sets of jack contacts extending from the front face of the mounting circuit board, each set of jack contacts being electrically connected to a respective set of insulation displacement contacts and adapted to mate with respective contacts of an inserted connector plug; and an electrically conductive front housing at the front face of the mounting circuit board substantially surrounding the sets of jack contacts individually and collectively to define a plurality of ports, each port having electrically conductive integral wall portions of the front housing defining a plug receiving cavity aligned with and substantially surrounding a respective set of jack contacts, the front housing being electrically insulated from the jack contacts and having an electrically conductive isolation barrier associated with each pair of adjacent sets of insulation displacement contacts, each isolation barrier extending from the front housing rearward beyond the mounting circuit board and between said adjacent sets of insulation displacement contacts.

2. A multi-port telecommunications connector panel according to claim 1, wherein each isolation barrier comprises a pair of spaced substantially parallel plates occupying the region between said adjacent sets of insulation displacement contacts.

3. A multi-port telecommunications connector panel according to claim 2, wherein the plates are paddle-shaped and substantially congruent.

4. A multi-port telecommunications connector panel according to claim 1, wherein each isolation barrier passes through a respective slot in the mounting circuit board.

5. A multi-port telecommunications connector panel according to claim 4, wherein each slot is at an edge of the mounting circuit board.

6. A multi-port telecommunications connector panel according to claim 4, including an electrically insulating rear housing covering the rear face of the mounting circuit board and flanking the insulation displacement contacts, the rear housing having an opening aligned with each slot in the mounting circuit board, through which opening an isolation barrier extends.

7. A multi-port telecommunications connector panel according to claim 6, including a plurality of fasteners securing the rear housing to the front housing, sandwiching the mounting circuit board therebetween.

8. A multi-port telecommunications connector panel according to claim 6, including an electrically insulating shroud surrounding the front housing, covering the front of the mounting circuit board and secured to the rear housing.

9. A multi-port telecommunications connector panel according to claim 8, wherein the shroud is secured to the rear housing by snap tabs projecting from the shroud that engage mating shoulders on the rear housing.

10. A multi-port telecommunications connector panel according to claim 1, wherein adjacent insulation displacement contacts of adjacent sets of insulation displacement contacts are offset.

11. A multi-port telecommunications connector panel according to claim 10, wherein adjacent insulation displacement contacts of each set are offset.

12. A multi-port telecommunications connector panel according to claim 1, wherein the front housing and the isolation barrier(s) are made of a conductive thermoplastic resin.

13. A multi-port telecommunications connector panel according to claim 12, wherein the front housing and the isolation barrier(s) are made of stainless steel fiber filled thermoplastic resin.

14. A multi-port telecommunications connector panel according to claim 1, wherein the mounting circuit board has electrically conductive traces that connect the jack contacts of each port to their respective insulation displacement contacts, and a ground plane for each port adjacent its respective electrically conductive traces for optimizing common mode impedance.

15. A multi-port telecommunications connector panel comprising:

a continuous mounting circuit board having opposed front and rear faces;

a plurality of sets of insulation displacement contacts extending from the rear face of the mounting circuit board;

a plurality of contact modules extending from the front face of the mounting circuit board, each contact module having a set of jack contacts electrically connected to a respective set of insulation displacement contacts and adapted to mate with respective contacts of an inserted connector plug;

an electrically insulating rear housing covering the rear face of the mounting circuit board and flanking the insulation displacement contacts, the rear housing being fastened to the front housing, sandwiching the mounting circuit board and the contact modules therebetween;

an electrically conductive front housing at the front face of the mounting circuit board substantially surrounding the contact modules individually and collectively to define a plurality of ports, each port having electrically conductive integral wall portions of the front housing defining a plug receiving cavity aligned with and substantially surrounding a respective contact module, the front housing being electrically insulated from the jack contacts and having a rearward extending, electrically conductive isolation barrier associated with each pair of adjacent sets of insulation displacement contacts, each isolation barrier passing through a respective slot in the mounting circuit board and an aligned opening in the rear housing and extending between said adjacent sets of insulation displacement contacts; and an electrically insulating shroud surrounding the front housing, covering the front of the mounting circuit board and secured to the rear housing.

16. An electrical connector panel according to claim 15, wherein each isolation barrier comprises a pair of spaced substantially parallel plates occupying the region between said adjacent sets of insulation displacement contacts.

17. A multi-port telecommunications connector panel according to claim 16, wherein the plates are paddle-shaped and substantially congruent.

18. A multi-port telecommunications connector panel according to claim 15, wherein each slot is at an edge of the mounting circuit board.

19. A multi-port telecommunications connector panel according to claim 18, wherein the mounting circuit board has electrically conductive traces that connect the jack contacts of each port to their respective insulation displacement contacts, and a ground plane for each port adjacent its respective electrically conductive traces for optimizing common mode impedance.

20. A multi-port telecommunications connector panel according to claim 15, wherein the shroud is secured to the rear housing by snap tabs projecting from the shroud that engage mating shoulders on the rear housing.

21. A multi-port telecommunications connector panel according to claim 15, wherein adjacent insulation displacement contacts of adjacent sets of insulation displacement contacts are offset.

22. A multi-port telecommunications connector panel according to claim 21, wherein adjacent insulation displacement contacts of each set are offset.

23. A multi-port telecommunications connector panel according to claim 15, wherein the front housing and the isolation barrier(s) are made of a conductive thermoplastic resin.

24. A multi-port telecommunications connector panel according to claim 23, wherein the front housing and the isolation barrier(s) are made of stainless steel fiber filled thermoplastic resin.

25. A multi-port telecommunications connector panel comprising:

a continuous mounting circuit board;

a plurality of sets of insulation displacement contacts on the mounting circuit board;

a plurality of sets of jack contacts on the mounting circuit board, each set of jack contacts being electrically connected to a respective set of insulation displacement contacts and adapted to mate with respective contacts of an inserted connector plug;

an electrically conductive housing substantially surrounding and separating the sets of jack contacts to define a plurality of ports, each port having electrically conductive integral wall portions of the housing defining a plug receiving cavity aligned with and substantially surrounding a respective set of jack contacts, the housing being electrically insulated from the jack contacts; and an electrically conductive isolation barrier disposed between each pair of adjacent sets of insulation displacement contacts, each isolation barrier being electrically connected to the front housing.

26. A multi-port telecommunications connector panel according to claim 25, wherein each isolation barrier is integrally formed with the housing.

27. A multi-port telecommunications connector panel according to claim 25, wherein the sets of jack contacts and the sets of insulation displacement contacts extend from opposite faces of the mounting circuit board.

* * * * *